US010772443B1

(12) United States Patent
Malcho

(10) Patent No.: US 10,772,443 B1
(45) Date of Patent: Sep. 15, 2020

(54) COLLAPSIBLE REACHING DEVICE

(71) Applicant: Matthew Malcho, Las Vegas, NV (US)

(72) Inventor: Matthew Malcho, Las Vegas, NV (US)

( * ) Notice: Subject to any disclaimer, the term of this patent is extended or adjusted under 35 U.S.C. 154(b) by 0 days.

(21) Appl. No.: 16/351,734

(22) Filed: Mar. 13, 2019

(51) Int. Cl.
*B25J 1/00* (2006.01)
*A47F 13/06* (2006.01)

(52) U.S. Cl.
CPC ..... *A47F 13/06* (2013.01)

(58) Field of Classification Search
CPC ..... A47F 13/06
USPC ..... 294/175, 132, 192, 142
See application file for complete search history.

(56) References Cited

U.S. PATENT DOCUMENTS 1,339,257 A * 5/1920 Callahan ..... A45B 3/00 135/66
3,182,960 A * 5/1965 French ..... F21V 33/00 254/134.7
4,324,494 A 4/1982 Pryor et al.
4,911,039 A * 3/1990 Lubbock ..... B25B 13/48 16/429
4,932,699 A * 6/1990 Hobson ..... B25B 9/00 294/92
5,119,688 A * 6/1992 Snyder, Jr. ..... B60W 30/18 135/66
5,463,918 A 11/1995 Lemieux
7,478,851 B2 * 1/2009 Geller ..... B25G 1/102 16/413
7,533,915 B2 5/2009 Johnson
7,673,912 B2 3/2010 Breininger
8,308,209 B1 * 11/2012 Bibow ..... B25G 3/22 294/175
8,385,546 B2 * 2/2013 Koch ..... G06F 21/10 380/228
8,813,414 B2 * 8/2014 Jones ..... A01K 97/14 294/175
9,238,302 B2 1/2016 Thibodeaux
D809,354 S 2/2018 Richer
2004/0100109 A1 * 5/2004 Johnson ..... A47F 13/06 294/26
2008/0217938 A1 * 9/2008 Sullivan ..... A47F 13/06 294/210
2010/0021279 A1 * 1/2010 Buzby ..... A47F 13/06 414/800
2013/0001969 A1 * 1/2013 Jones ..... B66F 19/00 294/175

* cited by examiner

*Primary Examiner* — Paul T Chin

(57) ABSTRACT

A collapsible reaching device for folding a passenger side mirror assembly includes a rod that comprises a plurality of nested sections so that the rod is selectively extensible. A hook is coupled to and extends from a first end of the rod, positioning a second end of the rod to be grasped in a hand of a user who is positioned in a driver's seat of a vehicle. The user can then position the hook on a mirror assembly that is coupled to a passenger side of the vehicle to selectively manipulate the mirror assembly between an extended configuration and a folded configuration.

16 Claims, 3 Drawing Sheets

COLLAPSIBLE REACHING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention.

(2) Description of Related Art including information disclosed under 37 CFR 1.97 and 1.98.

The disclosure and prior art relates to reaching devices and more particularly pertains to a new reaching device for folding a passenger side mirror assembly.

BRIEF SUMMARY OF THE INVENTION

An embodiment of the disclosure meets the needs presented above by generally comprising a rod that comprises a plurality of nested sections so that the rod is selectively extensible. A hook is coupled to and extends from a first end of the rod, positioning a second end of the rod to be grasped in a hand of a user who is positioned in a driver's seat of a vehicle. The user can then position the hook on a mirror assembly that is coupled to a passenger side of the vehicle to selectively manipulate the mirror assembly between an extended configuration and a folded configuration.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
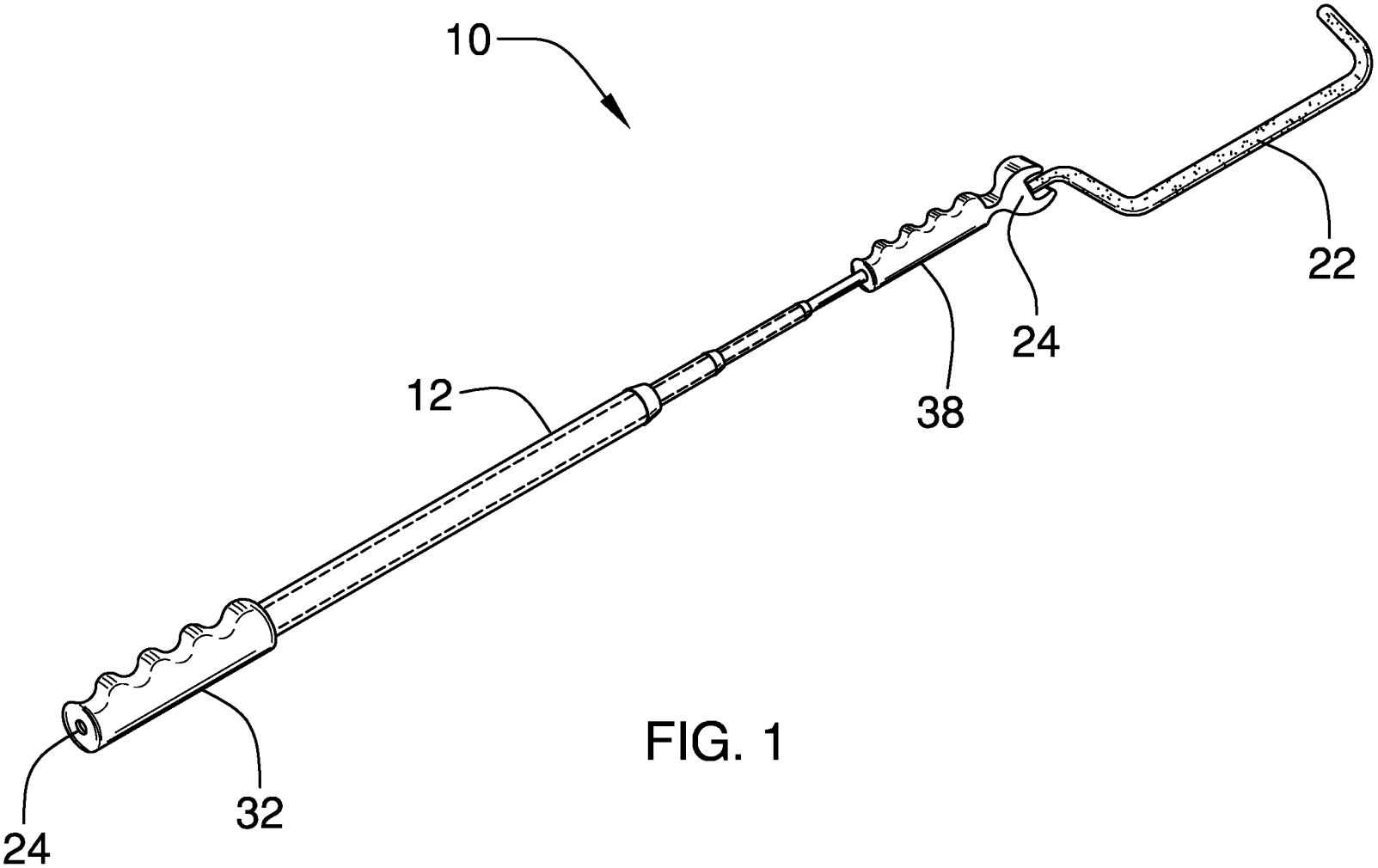
FIG. 1 is an isometric perspective view of a collapsible reaching device according to an embodiment of the disclosure.

With reference now to the drawings, and in particular to FIGS. 1 through 4 thereof, a new reaching device embodying the principles and concepts of an embodiment of the disclosure and generally designated by the reference numeral 10 will be described.

As best illustrated in FIGS. 1 through 4, the collapsible reaching device 10 generally comprises a rod 12 that comprises a plurality of nested sections 14 so that the rod 12 is selectively extensible. The rod 12 is shown collapsed in FIG. 2 and extended in FIG. 3. The rod 12 is substantially circularly shaped when viewed longitudinally. The plurality of nested sections 14 comprises a plurality of medial sections 16 that is positioned between a proximal section 18 and a distal section 20. The plurality of medial sections 16 comprises from one to five medial sections 16. The plurality of medial sections 16 comprises from two to four medial sections 16. The plurality of medial sections 16 comprises two medial sections 16.

Figure 4:
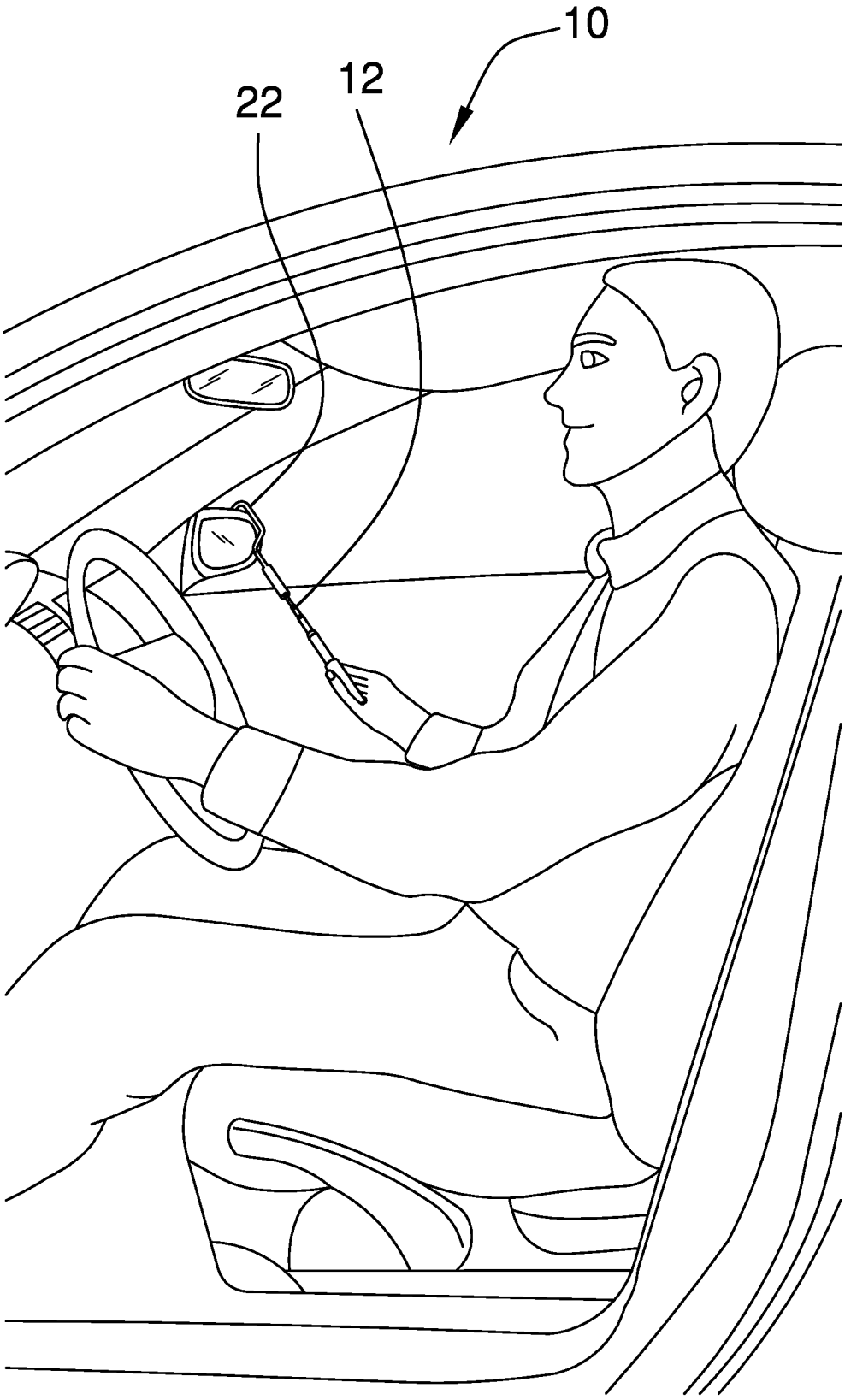
FIG. 4 is an in-use view of an embodiment of the disclosure.

A hook 22 is coupled to and extends from a first end 24 of the rod 12, positioning a second end 44 of the rod 12 to be grasped in a hand of a user who is positioned in a driver's seat of a vehicle. The user can then position the hook 22 on a mirror assembly that is coupled to a passenger side of the vehicle to selectively manipulate the mirror assembly between an extended configuration and a folded configuration, as shown in FIG. 4. The device 10 is particularly useful when parking a vehicle in a garage, during which activity mirror assemblies on the vehicle are susceptible to damage from impacting the sides of the garage opening. The device 10 allows the mirror assembly on the passenger side of the vehicle to be folded and extended without requiring the user to exit the vehicle, which is particularly desirable in inclement weather and for users who are physically challenged.

Figures 2, 3:
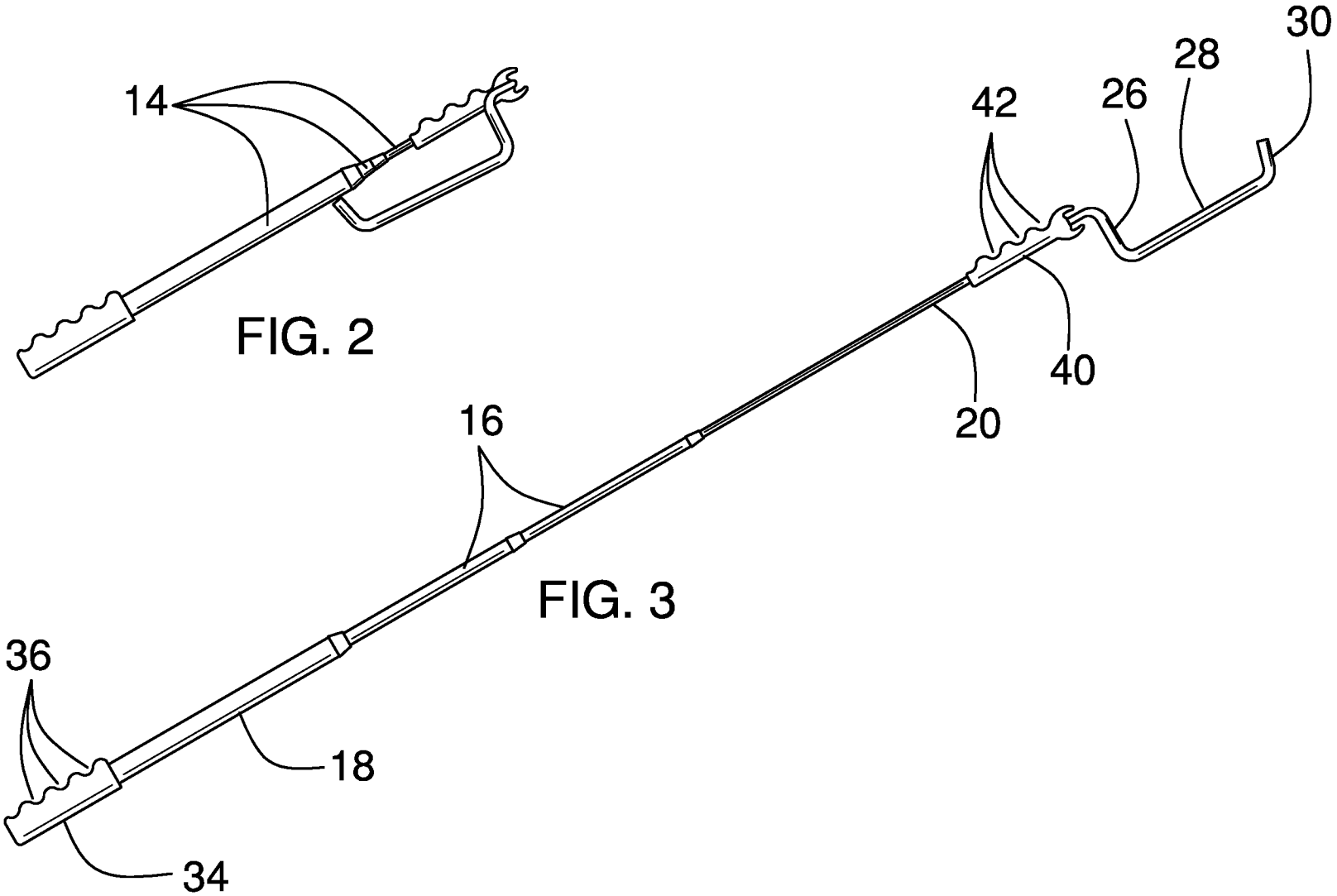
FIG. 2 is a side view of an embodiment of the disclosure.
FIG. 3 is a side view of an embodiment of the disclosure.

The hook 22 is coated with at least one of rubber and silicone so that the hook 22 is configured to position on the mirror assembly without scratching the mirror assembly. The hook 22 is pivotally coupled to the rod 12 so that the hook 22 is selectively positionable in an extended configuration, as shown in FIG. 3, and a folded configuration, as shown in FIG. 2. In the extended configuration the hook 22 extends from the first end 24 and is configured to position on the mirror assembly. In the folded configuration the hook 22 is positioned adjacent to the rod 12 and the hook 22 and the rod 12 are configured to be stowed.

The hook 22 comprises a first section 26, a second section 28, and a third section 30. The first section 26 is coupled to and extends substantially perpendicularly from the rod 12. The second section 28 is coupled to the first section 26 distally from the rod 12 and extends substantially perpendicularly from the first section 26 so that the second section 28 is substantially parallel to the rod 12. The third section 30 is coupled to the second section 28 distally from the first section 26 and extends transversely from the second section 28 so that the hook 22 is C-shaped. The first section 26, the second section 28, and the third section 30 each is substantially circularly shaped when viewed longitudinally.

A handle 32 that is coupled to the rod 12 proximate to the second end 44 of the rod 12 is configured to be grasped in the hand of the user. The user can then position the hook 22 on the mirror assembly to selectively manipulate the mirror assembly between the extended configuration and the folded configuration.

The handle 32 comprises at least one of rubber, silicone, and plastic. The handle 32 comprises a tube 34 that is positioned around and coupled to the rod 12 proximate to the second end 44. Each of a plurality of indentations 36 that is positioned in the tube 34 is configured to insert a respective digit of the hand as the hand grasps the tube 34.

A grip 38 that is coupled to the rod 12 proximate to the first end 24 is configured to be grasped in a first hand of a user, positioning the user to grasp the rod 12 proximate to the second end 44 with a second hand. The user then is positioned to selectively extend and collapse the rod 12.

The grip 38 comprises at least one of rubber, silicone, and plastic. The grip 38 comprises a cylinder 40 that is positioned around and coupled to the rod 12 proximate to the first end 24. Each of a plurality of recesses 42 that is positioned in the cylinder 40 is configured to insert a respective digit of the first hand as the first hand grasps the cylinder 40.

In use, the user seated in the driver's seat grasps the handle 32 in one hand and the grip 38 in the other hand to extend the rod 12. The user then can position the hook 22 through the passenger side window onto the mirror assembly to selectively manipulate the mirror assembly between the extended configuration and the folded configuration without having to exit the vehicle.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A collapsible reaching device comprising:

a rod comprising a plurality of nested sections such that the rod is selectively extensible;

a hook coupled to and extending from a first end of the rod wherein a second end of the rod is configured for grasping in a hand of a user positioned in a driver's seat of a vehicle positioning the user for positioning the hook on a mirror assembly coupled to a passenger side of the vehicle for selectively manipulating the mirror assembly between an extended configuration and a folded configuration; and a grip coupled to the rod proximate to the first end wherein the grip is configured for grasping in a first hand of a user positioning the user for grasping the rod proximate to the second end with a second hand such that the user is positioned for selectively extending and collapsing the rod.

2. The device of claim 1, further including the rod being substantially circularly shaped when viewed longitudinally.

3. The device of claim 1, further including the plurality of nested sections comprising a plurality of medial sections positioned between a proximal section and a distal section.

4. The device of claim 3, further including the plurality of medial sections comprising from one to five medial sections.

5. The device of claim 4, further including the plurality of medial sections comprising from two to four medial sections.

6. The device of claim 5, further including the plurality of medial sections comprising two medial sections.

7. The device of claim 1, further including the hook being coated with at least one of rubber and silicone wherein the hook is configured for positioning on the mirror assembly without scratching the mirror assembly.

8. The device of claim 1, further including the hook being pivotally coupled to the rod such that the hook is selectively positionable in an extended configuration wherein the hook extends from the first end and wherein the hook is configured for positioning on the mirror assembly, and a folded configuration wherein the hook is positioned adjacent to the rod wherein the hook and the rod are configured for stowing.

9. The device of claim 1, further including a handle coupled to the rod proximate to the second end of the rod wherein the handle is configured for grasping in the hand of the user positioning the user for positioning the hook on the mirror assembly for selectively manipulating the mirror assembly between the extended configuration and the folded configuration.

10. The device of claim 9, further including the handle comprising at least one of rubber, silicone, and plastic.

11. The device of claim 9, further including the handle comprising:

a tube positioned around and coupled to the rod proximate to the second end; and a plurality of indentations positioned in the tube wherein each indentation is configured for inserting a respective digit of the hand as the hand grasps the tube.

12. The device of claim 1, further including the grip comprising at least one of rubber, silicone, and plastic.

13. The device of claim 1, further including the grip comprising:

a cylinder positioned around and coupled to the rod proximate to the first end; and a plurality of recesses positioned in the cylinder wherein each recess is configured for inserting a respective digit of the first hand as the first hand grasps the cylinder.

14. A collapsible reaching device comprising:

a rod comprising a plurality of nested sections such that the rod is selectively extensible; and a hook coupled to and extending from a first end of the rod wherein a second end of the rod is configured for grasping in a hand of a user positioned in a driver's seat of a vehicle positioning the user for positioning the hook on a mirror assembly coupled to a passenger side of the vehicle for selectively manipulating the mirror assembly between an extended configuration and a folded configuration, the hook comprising a first section, a second section, and a third section, the first section being coupled to and extending substantially perpendicularly from the rod, the second section being coupled to the first section distally from the rod and extending substantially perpendicularly from the first section such that the second section is substantially parallel to the rod, the third section being coupled to the second section distally from the first section and extending transversely from the second section such that the hook is C-shaped.

15. The device of claim 14, further including the first section, the second section, and the third section each being substantially circularly shaped when viewed longitudinally.

16. A collapsible reaching device comprising:

a rod comprising a plurality of nested sections such that the rod is selectively extensible, the rod being substantially circularly shaped when viewed longitudinally, the plurality of nested sections comprising a plurality of medial sections positioned between a proximal section and a distal section, the plurality of medial sections comprising from one to five medial sections, the plurality of medial sections comprising from two to four medial sections, the plurality of medial sections comprising two medial sections;

a hook coupled to and extending from a first end of the rod wherein a second end of the rod is configured for grasping in a hand of a user positioned in a driver's seat of a vehicle positioning the user for positioning the hook on a mirror assembly coupled to a passenger side of the vehicle for selectively manipulating the mirror assembly between an extended configuration and a folded configuration, the hook being coated with at least one of rubber and silicone wherein the hook is configured for positioning on the mirror assembly without scratching the mirror assembly, the hook being pivotally coupled to the rod such that the hook is selectively positionable in an extended configuration wherein the hook extends from the first end and wherein the hook is configured for positioning on the mirror assembly, and a folded configuration wherein the hook is positioned adjacent to the rod wherein the hook and the rod are configured for stowing, the hook comprising a first section, a second section, and a third section, the first section being coupled to and extending substantially perpendicularly from the rod, the second section being coupled to the first section distally from the rod and extending substantially perpendicularly from the first section such that the second section is substantially parallel to the rod, the third section being coupled to the second section distally from the first section and extending transversely from the second section such that the hook is C-shaped, the first section, the second section, and the third section each being substantially circularly shaped when viewed longitudinally;

a handle coupled to the rod proximate to the second end of the rod wherein the handle is configured for grasping in the hand of the user positioning the user for positioning the hook on the mirror assembly for selectively manipulating the mirror assembly between the extended configuration and the folded configuration, the handle comprising at least one of rubber, silicone, and plastic, the handle comprising:

a tube positioned around and coupled to the rod proximate to the second end, and a plurality of indentations positioned in the tube wherein each indentation is configured for inserting a respective digit of the hand as the hand grasps the tube; and a grip coupled to the rod proximate to the first end wherein the grip is configured for grasping in a first hand of a user positioning the user for grasping the rod proximate to the second end with a second hand such that the user is positioned for selectively extending and collapsing the rod, the grip comprising at least one of rubber, silicone, and plastic, the grip comprising:

a cylinder positioned around and coupled to the rod proximate to the first end, and a plurality of recesses positioned in the cylinder wherein each recess is configured for inserting a respective digit of the first hand as the first hand grasps the cylinder.

* * * * *